United States Patent [19]

Bard et al.

[11] Patent Number: 4,993,208

[45] Date of Patent: Feb. 19, 1991

[54] MOLD FOR PRODUCING TILE-SHAPED FLOOR ELEMENTS FOR FORMING A DOUBLE FLOOR CONSTRUCTION AND A CORRESPONDING TILE-SHAPED FLOOR ELEMENT

[75] Inventors: Martin Bard, Amberg; Gottefried Cremer, Koln Junkersdorf, both of Fed. Rep. of Germany

[73] Assignee: Buchtal Gesellschaft mit beschrankter Haftung, Schwarzenfeld/Ops, Fed. Rep. of Germany

[21] Appl. No.: 249,313

[22] Filed: Sep. 26, 1988

[30] Foreign Application Priority Data

Sep. 29, 1987 [DE] Fed. Rep. of Germany ..... 3732802
Dec. 17, 1987 [DE] Fed. Rep. of Germany ..... 3742907
Feb. 8, 1988 [DE] Fed. Rep. of Germany ..... 3803740

[51] Int. Cl.[5] ..... E04F 19/02; E04C 2/38
[52] U.S. Cl. ..... 52/802; 52/829
[58] Field of Search ..... 52/601, 263, 126.6, 52/802, 813, 397, 829

[56] References Cited

U.S. PATENT DOCUMENTS 3,396,501 8/1968 Tate ..... 52/263
4,447,998 5/1984 Griffin ..... 52/263
4,640,854 1/1987 Radtke ..... 52/601
4,850,176 7/1989 Munsey et al. ..... 52/802

FOREIGN PATENT DOCUMENTS 2242607 4/1974 Fed. Rep. of Germany .
7519806 6/1975 Fed. Rep. of Germany .
7804148 7/1978 Fed. Rep. of Germany .
8106740 3/1981 Fed. Rep. of Germany .
334562C1 4/1985 Fed. Rep. of Germany .
8620150 7/1986 Fed. Rep. of Germany .
3603232A1 8/1987 Fed. Rep. of Germany .

*Primary Examiner*—Henry E. Raduazo
*Assistant Examiner*—Michael A. Van Patten
*Attorney, Agent, or Firm*—Kinney & Lange

[57] ABSTRACT

Tile-shaped floor elements for a double floor construction are produced with a mold consisting of a trough made of a material with high tensile strength and a ceramic cover tile closing the trough at the top and firmly connected with the trough via a connecting element. A flowable core layer is poured into this mold via openings in the bottom of the trough and hardens to form a firm compound between the trough and the core layer, on the one hand, and the core layer and the ceramic cover tile, on the other. In the production of this floor tile, the mold, in its totality, forms part of the finished floor element.

16 Claims, 2 Drawing Sheets

MOLD FOR PRODUCING TILE-SHAPED FLOOR ELEMENTS FOR FORMING A DOUBLE FLOOR CONSTRUCTION AND A CORRESPONDING TILE-SHAPED FLOOR ELEMENT

BACKGROUND OF THE INVENTION

1. Field of the Invention.

The invention relates to a mold for producing tile-shaped floor elements for a double floor construction and to such a floor tile. 2. Description of the Prior Art Double floor constructions are well-known and well established elements in modern offices, computing centers and places of production, which are in increasing demand due to the high flexibility they allow for in terms of the electrical supply of machines set up on such premises. Such a construction is generally a floor consisting of tile-shaped floor elements and the like which are borne via supports on a substructure. The journal "Fussbodenforum", No. 1, of January 1986, shows the newest prior art and says that in the case of unelastic floor coverings in the form of ceramic covering materials they are preferably applied on the construction site, whereas in the case of stone coverings and all others, including elastic ones such as carpeting, etc., the double floor constructions are produced as finished elements.

In view of the dimensions of 60×60 cm customary for an individual element for double floors, special demands are made on its loading capacity, its bow under load and the comprressive load in terms of point and surface load. Elastic coverings can make no contribution to carry static load, so that the double floor elements bearing such coverings must be designed so as to be alone capable of satisfying the required values. For this reason, one uses for such elements trough-shaped formations with high tensile strength and a filling with low tensile strength, i.e., a low modulus of elasticity, for example anhydride (German utility models nos. 78 04 148 and 81 06 740). Apart from the fact that such a construction is elaborate, these finished elements have a relatively large overall height with a corresponding dead weight. This is mainly due to the fact that the surface-ground core layer flush with the edge of the trough after setting is glued to the ceramic cover layer. This gluing also means that the compound tile-shaped floor element obtained has low shear strength, so that the cover tiles can gradually be detached due to the load on the floor.

It is known (German patent No. 33 45 620) to reduce the dead weight by adding spherical bodies of light construction material, but this increases production costs and does nothing to improve the overall height.

It is also known (German utility model no. 75 19 806) to use ceramic floor coverings for double floor constructions, but one uses synthetic-resin concrete reinforced by integrally cast grids. Such finished elements are elaborate to produce, heavy due to the reinforcement and have the great disadvantage of a corresponding overall height.

Another double floor construction is known (German laid-open print no. 36 03 232) formed of a compound consisting of a cover tile made of ceramic material with small layer thickness, a core layer made of rigid material with low specific gravity, and a thin bottom layer with high tensile strength, adhesives being used to ensure the bond between the compound layers. In view of the risk of breakage with ceramic tiles, adhesives with elastic properties are used. Since ceramic coverings, especially in the form of uniform tiles, for example as large as 60×60 cm, show a production-specific curvature of the tile plane, the adhesive is applied in corresponding dimensions and in excess to the initially prefabricated carrying element, when such tiles are laid, to compensate the curvature and ensure that the ceramic tiles are laid with a perfect fit.

According to another known construction (German utility Model no. 86 20 150), a sheet steel through filled with anhydride is provided to form a double floor tile, to which a paving tile is glued. The adhesive required serves at the same time as an edge band, i.e., a joint component, so that this adhesive must also show relatively elastic behavior.

Finally, tile-shaped floor elements for double floor constructions are known (German "auslegeschrift" No. 22 42 607) in the case of which a ceramic cover tile is placed on a trough and the compound is achieved by hardening of the core layer poured into the trough. No additional adhesive layer is required. Such a tile-shaped floor element is produced by placing the trough, which is open at the top, with its opening facing downward on a mold table provided with a recess for taking up the ceramic cover tile. Lateral flanges specially formed on the upper edge of the trough are overlapped by clamping means disposed along the periphery of the mold table to press the trough firmly onto the mold table. After the core layer has been poured in and hardened, the finished floor element can be removed from the mold table. This tile-shaped floor element also has a relatively large overall height, because the ceramic cover tile has its base on the trough. Furthermore, special molds are required for making the floor elements.

The known constructions, if capable of tansmitting sufficiently high moving and static loads, have a relatively large overall height, which leads to considerable problems in particular for the renovation of old buildings. Apart from this, the effort required to make these construction elements is relatively high due to the additional measures necessary for increasing their strength, which leads to accordingly high production costs. The mold for making such floor elements is also often elaborate itself, which again contributes to increasing the production costs. In the case of adhesives with elastic properties, the ability to transmit moving and static loads is limited.

SUMMARY OF THE INVENTION

The object of the invention is to allow for simple production of tile-shaped floor elements for a double floor construction which both ensure the transmission of high moving and static loads and are characterized by a small overall height and a very long life.

According to the invention, the tile-shaped floor elements are produced using a mold which itself constitutes in its totality a part of the finished floor element. The mold is formed of a trough forming the bottom layer of the floor element and preferably made of galvanized sheet steel, and a ceramic cover tile closing the trough at the top, which together with the trough limits the mold cavity for taking up the core layer. The cover tile is partly inserted into the trough, so that the tile is partly immersed in the trough and protruding with its visible side beyond the upper edge of the trough, which has a favorable effect for the sealing of the joint between the tile and the trough and on the overall height of the floor element. The ceramic cover tile is stabilized or fixed in its position relative to the trough by means of spacers which are formed in a simple manner by rods or flaps welded to the trough or attached thereto in some other suitable way, for instance by screws or staples. The firm bond between the cover tile and the trough is established by a plastic connecting element formed on from the outside. To produce the floor element, one need only pour the core layer into this mold formed by the trough and cover tile, which is done through openings of the bottom of the trough. Due to the firm bond between the parts of the mold, which at the same time themselves all constitute parts of the finished floor element, the unfitted mold can be transported to the destination before the core layer is poured in. Consequently the material of the core layer can be selected dependent on the necessities of the destination site. This simplifies transport quite considerably, because only the mold and not the finished floor element needs to be transported. The floor element is only produced on the site before being laid.

The connecting element is formed of a joint-forming, viscoplastic material. The floor tiles produced in this way can be butt-jointed without any need to introduce additional joint-filling material between the tiles after laying. Instead, the joint function between the ceramic cover tiles of the floor covering is taken care of by the connecting elements already formed on.

The firm bond resulting upon hardening of the core layer due to the frictional connection between the trough and the core layer, on the one hand, and the core layer and the ceramic cover tile, on the other, is further promoted if the contact surfaces of these layers are of irregular formation, for instance bearing low reliefing. This makes it possible to obtain a form closure between the contact surfaces additionally.

For particular applications it is expedient to provide a bonding bridge between the ceramic cover tile and the core layer, on the one hand, and between the core layer and the trough, on the other,. For this purpose, one applies to the corresponding surfaces of the trough and the ceramic cover tile contacting the core layer, before pouring in the latter, a thin layer of modified, solvent-free synthetic-resin dispersion as a bonding bridge. The shear strength of the bonding bridge is equal to or greater than that of the core layer.

The bottom of the trough is expediently provided with large openings, so that it is largely open and supported only by a frame running around the edge or a supporting cross or grid. Trapped air can escape through these large openings in the bottom of the trough when the core layer is being poured in, and moisture can also be removed that might impair the setting of the flowable core layer.

The finished floor element is characterized by a low height, since the ceramic cover tile is set in the trough and protrudes outward only partly beyond the upper edge of the trough. The connecting element, which ensures an immovable fixation of the ceramic cover tile and the trough before the core layer is poured in, serves at the same time as an edge protection for the ceramic cover tile, but in particular also as a joint filler between the adjacent ceramic cover tiles of the finished floor covering, since when the finished floor elements are laid edge to edge the contiguous connecting elements of adjacent floor elements require no subsequent pointing. For having a uniform appearance of the joint and the cover, it is expedient if the top surface of the connecting element is slightly recessed from the protruding visible surface of the ceramic cover tile.

The invention is suitable in particular for double floor construction with a format of 60×60 cm for the individual element. The thickness of the finished floor element is preferably 30 to 40 mm. The thickness of the ceramic cover tile is preferably 8 mm. The thickness of the bonding bridge is less than 1 mm.

BRIEF DESCRIPTION OF THE DRAWINGS

In the following, preferred exemplary embodiments of the invention shall be described with reference to the drawing, in which.

DETAILED DESCRIPTION OF THE PREFERRED EMBODIMENTS

Figure 1:
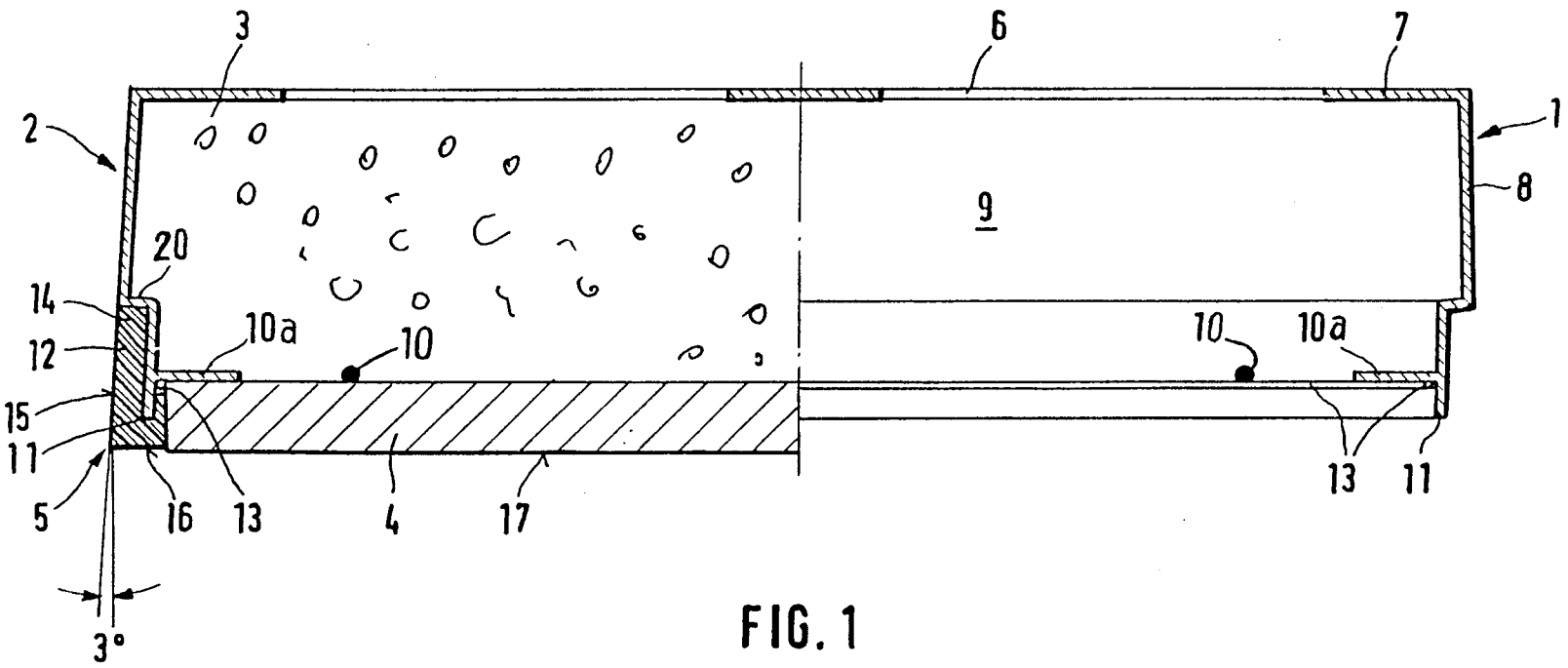
FIG. 1 shows a schematic sectional view of a floor tile or a mold according to the invention, placed in the mold filling position.

FIG. 1 shows schematically and in a sectional view, in the right half, a trough referred to as 1 which forms a part of the mold for making the tile-shaped floor element to be described in the following. The left half of FIG. 1 shows a section of the tile-shaped floor element marked generally as 2 and comprising trough 1, a core layer 3 poured thereinto, and a ceramic cover tile 4 taken up in trough 1 and firmly connected thereto by a connecting element 5.

The mold for producing floor tile 2 comprises trough 1 shown in the right half of FIG. 1 and comprising a bottom 7 provided with large openings 6, and side walls 8 limiting a receiving space 9 for core layer 3 poured in through openings 6. On the side opposite bottom 7, trough 1 is open and designed to take up ceramic cover tile 4. To take up this cover tile 4, spacers 10 **10*a* are disposed on the inside of side wall 8 for fixing the position of cover tile 4. At this point it must be mentioned that to produce the mold, trough 1 is disposed with its bottom 7 pointing downward, so that cover tile 4 is placed from above on spacers 10 and 10*a*. The representation in FIG. 1, in which bottom 7 is on top, shows only the filling position of the mold for producing the floor tile, in which ceramic cover tile 4 is at the bottom and bottom 7** of the trough is on top to make it easier to pour in the flowable core material.

Spacers 10 and **10*a* provided in the embodiment shown are formed by bolts or rods 10 attached to the trough, for example by welding, stapling or screwing or, in the case of sheet metal flaps 10*a*, by bending portions punched out of the trough. In the embodiment shown, in which the trough has a square plane view, two spacers 10 are provided on each side of the trough, i.e., eight spacers 10 10*a* altogether, on which ceramic cover tile 4** is placed.

As FIG. 1 shows quite clearly, spacers 10 and **10*a* are disposed far enough below upper edge 11 of the trough that ceramic cover tile 4 stabilized by spacers 10 and 10*a* is embedded only partly within trough 1. Ceramic cover tile 4 thus protrudes with part of its height or thickness beyond upper edge 11 of the trough 1, i.e., cover tile 4 and the edge of the trough overlap in their height. The firm bond of trough 1 and ceramic cover tile 4 stabilized in the trough is established by a connecting element 12 which is formed or injected on the upper edge portion of the trough from the outside. In order to prevent the material of connecting element 12 from penetrating into the interior of the mold, a sealing ring 13 is provided, which is placed on spacers 10 and 10***a* and disposed between the side edge of ceramic cover tile 4 and the opposite surface of the trough. Because of the partly immersed arrangement of the tile 4 in the trough 1 there is a defined gap between the opposing faces of the trough and adjacent edge of the tile for taking up the sealing ring 13 and the material of connecting element 12.

To take up the connecting element 12, a recess referred to as 14 is provided, in the embodiment shown, in the upper area of trough 1, which is preferably made of a galvanized sheet steel. The recess is formed by bending side wall 8 at place 15, so that upper wall portion 16 of the side wall is slightly recessed. The material of connecting element 12 is poured or injected into the resulting space, i.e., into recess 14.

Connecting element 12 is made of a joint-forming and viscoplastic material formed by a plastic fit for pouring or injecting, preferably polyurethane. When forming the connecting element, the polyurethane engages behind upper wall portion 16, backfilling the very narrow annular gap between ceramic cover tile 4 and the opposite surface of the trough 1. Sealing ring 13, that seals this gap from the interior of the mold and serves as a lost seal, is for example made of cellular rubber, since the seal is only required until the material of the cast plastic has solidified.

Side surface 15 of connecting element 12 is substantially flush with side wall 8 of mold 1 and is also somewhat inclined outwardly, regarded from the bottom of the mold, as indicated by the angle stated in FIG. 1. The preferred angle of inclination is 3°. Top surface 16, on the other hand, is disposed slightly behind visible surface 17 of ceramic cover tile 4, preferably about 0.4 mm, so that ceramic cover tile 4 protrudes slightly upward beyond top surface 16 of connecting element 12.

The mold produced after connecting element 12 is formed (consisting of trough 1, ceramic cover tile 4 and connecting element 12) is firm enough that it need not be filled on the spot, but can be transported to the place where the floor element is to be finished. This means that filling can also be performed directly at the place of use, so that the material can be selected appropriately.

To produce the floor tile itself, a flowable material is poured through openings 6 in bottom 7 of trough 1 or the mole to form the core layer, whereby anhydride is preferably used. After core layer 3 is poured in it comes in full contact with the inner surfaces of mold 1 and the surface of ceramic cover tile 4 opposite visible surface 17. Upon hardening of core layer 3, an initmate compound arises between trough 1 and the core layer 3 and between the core layer 3 and ceramic cover tile 4, whereby the compound consisting of the trough, core layer and ceramic cover tile has high shear strength. By providing appropriate reliefing on the contact surfaces of the trough and/or the cover tile, one can additionally obtain a form closure.

Due to the special design of connecting element 12, the floor tiles for forming the double floor construction can be laid in close-fitting fashion on supports, so that the side edges of adjacent floor tiles hit each other without leaving any joints to be filled with additional joint material. This manner of laying is promoted by the slope of the side surfaces of the connecting elements which virtually form the joint between adjacent ceramic cover tiles of the floor covering.

In a preferred embodiment, trough 1 serves to take up ceramic cover tiles with a size of about 60×60 cm, whereby trough 1 accordingly has a square plan view. The total height of the floor tile is between 3 and 4 cm. The height of the connecting element, calculated from inward bend 20, is about 1.5 to 2 cm. The thickness of the ceramic cover tile is preferably 8 mm. The side surfaces are inclined outwardly at an angle of 2° to 5°, preferably 3°. The width of top surface 16 of connecting element 12 is about 4 mm.

Figure 2:
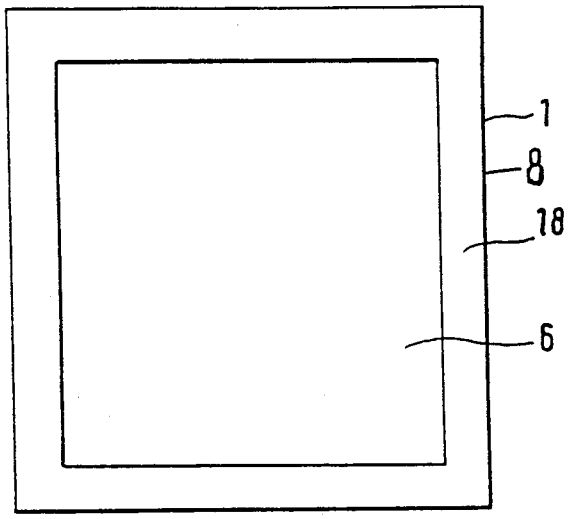
FIGS. 2, 3 and 4 show views of the bottom of various embodiments of the inventive floor element, seen from the rear side.
Figure 3:
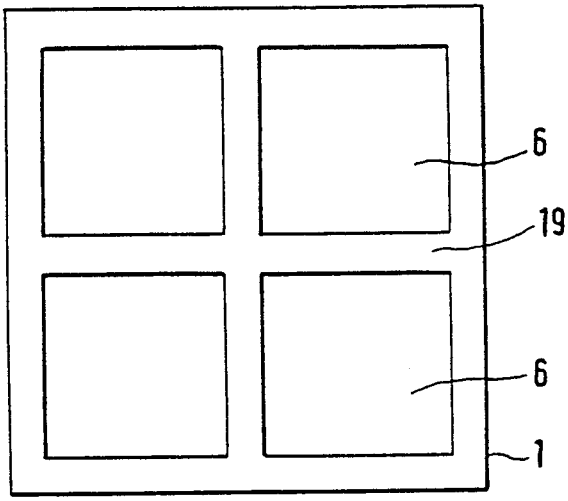
Figure 4:
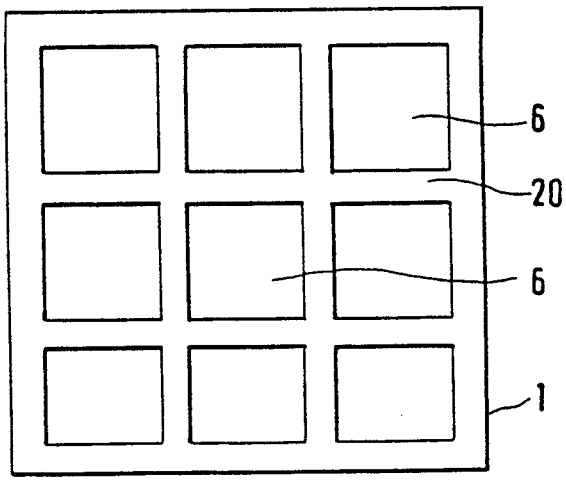

FIGS. 2 to 4 indicate that the bottom of the trough has a largely open design except for a supporting frame or grid that remains. In the embodiment of FIG. 2, side walls 8 of trough 1 have a closed design, but the bottom shown in FIG. 2 is provided with an opening 6 so that most of the outer surface of core layer 3 facing away from ceramic cover tile 4 is exposed, i.e., not covered by the bottom of the trough. However, vertical side walls 8 of trough 1 extend over the edges of core layer 3, so that the bottom is formed by a supporting flange 18 running around it and limiting opening 6. In the case of a ceramic cover tile 4 with outside dimensions of 60×60 cm, the width of the supporting flange is perferably about 2 cm, so that the inside diameter of opening 6 of substantially square formation is about 56 cm.

In the embodiment of FIG. 3, the bottom of trough 1 is formed substantially by a supporting cross 19 which limits with the edges of trough openings 6. In the modified embodiment of FIG. 4, supporting cross 19 is replaced by a supporting grid 20 that forms the bottom of the trough, leaving openings 6. Openings 6 present in the bottom of the trough in the embodiments of FIGS. 2 to 4 have a size such that most of the surface of core layer 3 facing away from the ceramic cover tile is exposed toward the outside, i.e., not covered by the bottom of the trough. Supporting flange 18 or supporting cross 19 or supporting grid 20 constitutes a tensionproof bottom layer of the floor tile, being of sufficiently stable and rigid construction. The openings in the bottom of the trough have the advantage that the core layer can be poured in through them. But these embodiments allow in particular for sufficient ventilation since air trapped within the trough can escape when the flowable core layer is being poured in. Furthermore, moisture that could impair the setting of the flowable core layer can escape through the openings in the bottom of the trough. If required, it may be expedient to solidify the core layer by embedding short fibers, in particular glass fibers. After curing was effected, it is possible to cover the openings, for example by way of a foil, which prevents entry of moisture.

Not shown in the embodiment of FIG. 1 is an optionally used bonding bridge provided between the ceramic cover tile and the core layer and between the core layer and the surfaces of trough 1 contacted by the core layer. The material used for the bonding bridge, which is applied in a very thin layer to the corresponding sides of the ceramic cover tile and the trough before the core layer is poured in, is a modified solvent-free synthetic-resin dispersion. The bonding bridge promotes the compound between the trough and the core layer, and the core layer and the ceramic cover tile after the core layer has hardened.

What is claimed is:

1. A mold for producing a tile-shaped floor element for a double floor construction, comprising a trough made of a material with high tensile strength for taking up a flowable, hardenable core layer made of rigid material that, in a compound with the core layer and the trough, forms the floor element, characterized in that the mold, in its totality, is part of the floor element (2) since the trough (1) and ceramic cover tile (4) are stabilized by spacers (10, 10*a*) and firmly interconnected to form the mold by a joint-forming, viscoplastic material (12) along the peripheral edge of the cover tile (4), and in that the flowable core layer (3) is poured into this mold and, after hardening, forms a compound having high shear strength with the trough (1) and ceramic cover tile (4).

2. The mold of claim 1, characterized in that the ceramic cover tile (4) and the trough (1) are of irregular formation on the sides facing the core layer, so that upon hardening of the core layer one obtains a form closure of the core layer with the trough and the ceramic cover tile.

3. The mold of claim 1, characterized in that a bonding bridge is provided between the ceramic cover tile (4) and the core layer (3) and between the core layer (3) and the trough (1), the shear strength of said bridge being equal to or greater than that of the core layer (3).

4. The mold of claim 3, characterized in that the bonding bridge is made of modified solvent-free synthetic-resin dispersion as a base.

5. The mold of claim 1, characterized in that the ceramic cover tile (4) is taken up by the spacers (10), 10*a* in the trough (1) in such a way that a portion of the cover tile (4) is recessed within the trough (1) and another portion of the cover tile (4) evenly protrudes outward with beyond an upper edge (11) of the trough (1).

6. The mold of claim 1, characterized in that an upper edge portion (16) of the trough (1) is slightly recessed from a side wall (8) of the trough (1) in a lower area of the trough (1) to form a recess (14) running around an upper edge (11) of the trough (1) that serves to take up the joint-forming material (12).

7. The mold of claim 1, characterized in that a sealing ring (13) runs all around between the ceramic cover tile (4) and an adjacent side wall (8) of the trough (1).

8. The mold of claim 1, characterized in that the spacers (10), 10*a* are formed by bolts or flaps which are formed on the trough (1) or attached thereto and protrude into the interior thereof.

9. The mold of claim 1, characterized in that two spaced bolts are provided as spacers (10), 10*a* on each side of the trough (1).

10. The mold of claim 1, characterized in that a bottom (7) of the trough (1) has one or more open areas (6) of a size such that most of the surface of the core layer (3) facing away from the ceramic cover tile (4) is uncovered.

11. The mold of claim 10, characterized in that the bottom (7) of the trough (1) is formed by a supporting flange (18) running all around a bottom edge of the trough (1), covering only the edge areas of the surface of the core layer (3) facing away from the ceramic cover tile (4) and limiting an opening (6).

12. The mold of claim 10, characterized in that the bottom (7) of the trough (1) is formed by a supporting cross (19) or a supporting grid (20).

13. A tile-shaped floor element for a double floor construction, whereby the tile-shaped floor elements are borne directly or indirectly on supports set up at predetermined intervals on a stable substructure, and are each formed of a compound consisting of a trough made of a material with high tensile strength, a core layer of hardenable material poured into said trough, and a ceramic cover tile covering an open top side of the trough, characterized in that the ceramic cover tile (4) is inserted into the trough (1) and evenly protrudes outward with its outwardly facing display surface (17) beyond the upper edge (11) of the trough (1), and in that the overlapping peripheral edge of the trough (1) and the ceramic cover tile (4) is covered all around from the outside by a connecting element (12) made of a joint-forming, viscoplastic material which has its top surface (16) surrounding and slightly recessed behind the display surface (17) of the ceramic cover tile (4).

14. The floor element of claim 13, characterized in that the connecting element (12) is substantially flush with a side wall (8) of the trough (1).

15. The floor element of claim 14, characterized in that side surfaces of the floor element (2) are inclined outwardly from a bottom (7) of the trough (1) at an angle of 2° to 5°.

16. The floor element of claim 15 , characterized in that side surfaces of the floor element (2) are inclined outwardly from a bottom (7) of the trough (1) at an angle of 3°.

* * * * *

UNITED STATES PATENT AND TRADEMARK OFFICE

CERTIFICATE OF CORRECTION

PATENT NO. : 4,993,208

DATED : February 19, 1991

INVENTOR(S) : Martin Bard et al.

It is certified that error appears in the above-identified patent and that said Letters Patent is hereby corrected as shown below:

Col. 7, line 27, delete "(10), 10a", insert --(10, 10a)--.

Col. 7, line 31, after "outward", delete "with".

Col. 7, line 45 delete "(10), 10a", insert --(10, 10a)--.

Col. 8, line 2, delete "(10), 10a", insert --(10, 10a)--.

Signed and Sealed this

Twenty-fourth Day of November, 1992

*Attest:*

DOUGLAS B. COMER

*Attesting Officer*

*Acting Commissioner of Patents and Trademarks*